US005224844A

United States Patent [19]

Lopez

[11] Patent Number: 5,224,844

[45] Date of Patent: Jul. 6, 1993

[54] FRAME INDEPENDENT ELECTRIC BLOWER HOUSING

[76] Inventor: Robert Lopez, 1219 S. Bonview Ave., Ontario, Calif. 91761

[21] Appl. No.: 699,908

[22] Filed: May 14, 1991

[51] Int. Cl.[5] ..... F04B 17/00; F04B 35/04

[52] U.S. Cl. ..... 417/423.1; 417/423.14

[58] Field of Search ..... 417/423.1, 423.14, 423.2, 417/423.15, 360

[56] References Cited

U.S. PATENT DOCUMENTS 4,950,133 8/1990 Sargent ..... 417/423.14

FOREIGN PATENT DOCUMENTS 2720301 9/1978 Fed. Rep. of Germany ..... 417/423.14

1434226 5/1976 United Kingdom ..... 417/423.14

*Primary Examiner*—Richard A. Bertsch
*Assistant Examiner*—Alfred Basichas
*Attorney, Agent, or Firm*—Robert N. Schlesinger

[57] ABSTRACT

This invention relates to an in-line and frame independent electric blower housing, with cylindrical walls or essentially nonparallel interior walls constructed of an elastomeric material, and which is thereby acoustically silenced and is also easily disassembled for maintenance. The blower housing consists of two halves and may be adapted to house a larger motor, through the fitting of an adapt or collar device between the two halves of the blower housing. The blower housing was designed for use in the spa industry, as an air blower, but has applications in other industries.

16 Claims, 15 Drawing Sheets

FRAME INDEPENDENT ELECTRIC BLOWER HOUSING

BACKGROUND

1. Field of the Invention

This invention relates to a frame independent electric blower housing which may be mounted in-line, with essentially nonparallel interior walls, and which is thereby acoustically silenced and is also easily disassembled for maintenance.

2. Description of the Prior Art

A primary application of this invention is to house the electric blowers used in the spa industry, in an acoustically silenced housing with essentially nonparallel interior walls. The essentially nonparallel interior walls may have a geometry which is spherical or the zone of a sphere, cylindrical, conical or a frustum of a cone, or a combination of these geometries. Nonparallel walls as cited throughout this specification and claims are comprised of the above geometries. Blower used in the spa industry for blowing air, rather than another fluid, are sometimes referred to as aerators. Throughout this specification, the term "blower" is meant to also include the nearly synonymous term "aerator". Other applications for this invention include, but are not limited to blowers used in, e.g., air purification systems and the blowers used in various other industries.

This blower housing invention is frame independent and is easily disassembled for maintenance. This blower housing may be mounted in-line. The term "in-line", as cited throughout this specification and claims, means that the fluid or air flow travels straight through the blower, so as not to obstruct the fluid or, e.g., air. Other blowers in the industry make a curved, deflected or 90 degree turn, and thereby do not provide a smooth, clear, and laminar flow, without turbulence or obstructions which may have a variety of mechanical and acoustic disadvantages. The electric blower housings used in the spa industry have the disadvantage of being noisy and the vibration and flutter from this noise resonates throughout much of the spa, causing annoyance and discomfort to those using the spa. Thus, there is a need and a demand for an acoustically silenced or noise minimized electric blower housing.

Throughout this specification and its claims, the terms: housing, enclosure, casing, and cover are meant to be synonymous; and although the term "housing" will be used, that term is understood to also mean enclosure, casing, or cover.

Another disadvantage of the electric blower housings used in the spa industry, is that they require considerable effort and time to retrieve or replace the motor. In the event of blower motor failure, it is a common practice in the spa industry to replace both the motor and its housing, rather than to service the motor or to replace the motor. This may be particularly expensive when one considers that the blower housing is often more expensive than the blower motor. The present invention solves many of these industry problems and is a significant advancement is the technology of housing blowers, i.e., motors, and particularly those used in the spa industry.

In trying to solve these disadvantages or problems, and within the scope of this objective, it was surprising to find that the present invention need not be comprised of a highly complicated design or of advanced materials, and that it need not be expensive or difficult to manufacture.

OBJECTIVES AND ADVANTAGES OF THE INVENTION

The objectives and advantages of this invention are:

1) The blower housing is frame independent and may be mounted in-line, without being bolted or mounted directly to the framework of the spa, or an independent framework supporting the blower housing. Other blowers are: a)frame dependent (bolted or mounted directly to the frame of the spa or to an independent framework and the housing itself is a part of such framework, extending throughout the spa system) and will thereby transmit vibration and noise throughout the spa via the framework, or are b) in-line and buried underground and are thereby difficult to service. The frame dependent blowers frequently use foam inserts to dampen the sound within the housing, which indicates that the manufacturer's of these blowers do not intend for the internal housing geometry to be an adequate inhibitor of noise. The blower housings typically used, e.g., in the spa industry, are made from such materials as metal or plastic, which tend to resonate and may tend to amplify acoustical noise.

2) The blower housing is structured so that one fastening member, e.g., a hose clamp, mounts each of the separate halves of the two piece blower housing to the fluid or air passageway, duct system, plumbing, tubing, or flow piping. The essentially synonymous terms: passageway, duct system, plumbing, tubing, and flow piping, is hereinafter referred to as "flow piping". This use of one fastening member to hold the blower housing together allows for easy mounting, assembly, and servicing of the blower motor.

3) The blower housing is air sealed, i.e., air tightly sealed, by means of fastening members, such as a hose clamp. The air seal includes a fastening member sealing the opening provided for the electrical connection cord and for strain relief of the electrical connection cord. The intake opening and the output (or exhaust) opening are also each air sealed with a fastening member, such as a hose clamp. The two halves of the blower housing are held in place and together in an air sealed manner, through the use of another fastening member, such as a hose clamp. When the adaptor collar device, which is a part of the present invention, is used to adapt the blower housing to accommodate larger motors, the adaptor collar device is held in place with another fastening member, such as a hose clamp, in an air sealed manner. These fastening members prevent air escape at any orifice other than the intended air intake/output openings.

4) A preferred embodiment of the blower housing (and its adaptor collar device) is constructed of neoprene (60/70 Shore) for noise insulation and for acoustically silencing the blower.

The use of this elastomeric or polymeric material, such as neoprene 60/70 Shore, has the effect of further dampening the vibration and noise of the blower system, due to this material's elastomeric and porous material nature and its consequent sound absorbing qualities. The blower housings typically used in the spa industry are constructed of parallel metal or plastic walls. The present blower housing invention, however, utilizes its in-line positioning and the nonparallel interior walls to minimize acoustical waves emanating through the flow piping and to minimize the noise from the vibration and flutter from the motor. This means of reduction in the acoustical noise, vibration, and flutter, in the present invention does not create a reduction in the flow rate or function of the blower or the blower motor.

5) The blower housing may be opened, for servicing or replacement of the motor, by the unfastening of the fastening member. When a hose clamp is used as the fastening member, the blower housing may be opened for servicing of the motor, by the loosening of the hose clamp's one screw, rather than the numerous screws that are typically used to fasten other blower housings used in the spa industry.

6) The air flow (when the blower is, e.g., used in the spa industry, and used to blow air, rather than another fluid) is through a direct path and not through a curved, 90-degree, L-shaped, deflected, or "broken-off" path, as is commonly found in blowers used in the spa industry. This direct air flow path has mechanical as well as acoustical advantages over the less efficient, indirect or nonlaminar flow paths for the fluid or air.

7) The blower housing is compact, but may efficiently accommodate a larger sized (or larger horsepower) motor through the use of an adaptor collar device, which is a part of the present invention, and which fits between the two halves of the blower housing, thereby expanding the payload section of the interior of the housing, where the motor is housed.

8) The blower housing is not only directed to an improved blower housing with a reduced noise level and the various advantages listed above, but to its improved efficiency. This efficiency being a result of, e.g., the simple and economical manner in which the blow housing may be constructed, assembled and serviced, and to the fact that it may be connected in-line with the flow piping and does not cause the flow of the fluid, e.g., air, to make a curved, 90 degree, L-shaped, deflected, or "broken off" path. This connection of the blower in-line with the "air" flow path is not only an improved engineering design for the efficiency of the system and the work load on the blower motor, but is also significant in that there is a further noise reduction in the present invention due to this in-line flow, because the noise due to the essentially laminar air flow is significantly less than that found in other blowers where the flow is not as direct and smooth and may have considerable turbulence, and consequently, additional noise and vibration.

SUMMARY OF THE INVENTION

The present invention is an acoustically silenced, frame independent electric blower housing. This electric blower housing was invented by Robert Lopez. This invention is an electric blower housing and is of particular utility in the spa industry, where the electric blowers blow fluids, usually air, through the flow piping, e.g., to the water filled spa. It should be pointed out that blower motors used in the spa industry are often between a one horsepower and a three horsepower motor size, and these motors are of a often uniform size, such as those manufactured by Ametek's Lamb Electric Division. The motors used in the spa industry, however, may be more than the three horsepower size, and varying embodiments of the present invention may be used to house such varying sizes in the blower motor.

This blower housing invention also has utility in other industries and in, e.g., air purification systems that use blowers.

This blower housing is frame independent and may be mounted in-line with the system's flow piping. The blower housing is acoustically silenced due to its internal wall configuration being of cylindrical or essentially nonparallel interior walls. The blower housing is further acoustically silenced due to the nonparallel walls being constructed of an elastomeric material or a polymeric material, such as neoprene 60/70 Shore, and the fact that the blower is frame independent and may be mounted in-line, so as to minimize the noise and resonance of the fluid flow through the flow piping, and the motor's vibration and flutter throughout the system, e.g., the spa.

The blower housing is comprised of two halves, which are held together in an air sealed manner through the use of a fastening member, such as a hose clamp. Two fastening members are also used to air seal the housing to both the intake and the output (or exhaust) flow piping. Another fastening member is used to air seal the electrical cable which powers the motor within the blower housing.

The blower housing may, e.g., be used for a one horsepower motor, when applied to the spa industry. When a larger motor, e.g., a one and one-half or two horsepower motor, is needed, the blower housing may accommodate such a larger motor through the use of an adaptor collar device placed between the two halves of the blower housing, thereby expanding or extending its volume, capacity, or payload to accommodate larger motors.

In a preferred embodiment of this invention, the fastening members are hose clamps and these hose clamps utilize one screw to form an air-seal and to hold the connected pieces together. The blower housing fits snug against or around the motor where the cylindrical portion of the two halves of the blower housing meet, and are held together in an air sealed manner through the use of the fastening member, e.g., the hose clamp. This snug fitting of the blower housing against or around the cylindrical and largest dimension of the motor further minimizes the effects of the motor vibration and flutter, due to the elastomeric material composition of the blower housing acoustically silencing the vibration and flutter of the motor.

When the third (and optional) blower housing piece, i.e., the adaptor collar device, is used, the interface of the two halves of the blower housing as well as the adaptor collar device fits snug against and around the cylindrical and largest dimension of the blower motor and also causes an air-seal through the use of a fastening member or members. This snug fitting of the blower housing against and around the largest dimension of the motor also further minimizes the effects of the motor vibration and flutter, due to the material composition of the blower housing and its adaptor collar device, acoustically silencing the vibration and flutter.

The blower housing and its adaptor collar device are shaped so as to grip or hold the largest dimension (i.e., the cylindrical or canister portion) of the blower motor snug or tight within and between the two housing halves (and the adaptor collar device, if used), which are tightly held in place through the use of one or more fastening members.

Further objects, features, and advantages of the present invention will become more apparent from the following description when taken with the accompanying drawings which show, for purposes of illustration only, an embodiment construction in accordance with the present invention.

DRAWING FIGURES

The drawings reflect the best embodiment of the blower housing, as is intended for use in the spa industry, but is not limited to such use.

REFERENCE NUMERALS IN THE DRAWINGS

Figure 1:
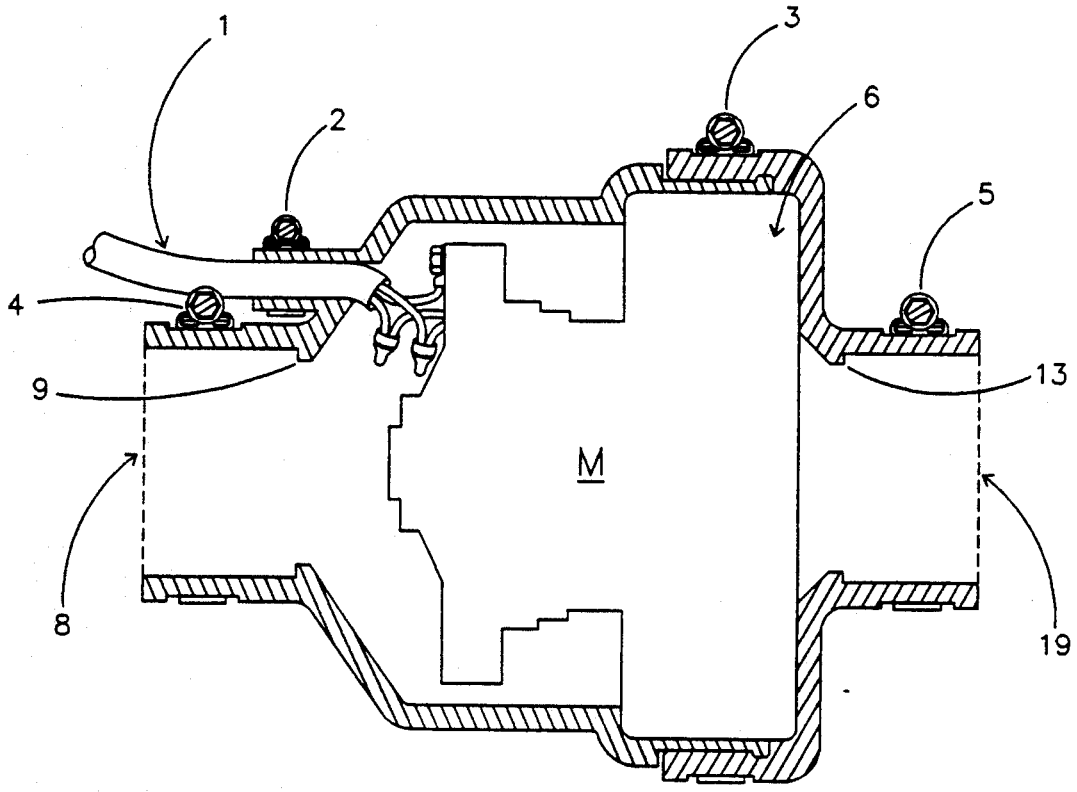
FIG. 1 shows a sectional side view of the blower housing as it would appear when the two halves are connected together through the use of a hose clamp as the fastening member.

Referring now to the drawing figures, like reference numerals are used to refer to like specific parts of the various Figures. The reference numerals used to describe the various parts of the Figures follow.

1. Electric Power Cable (1), for the blower motor.
2. Hose Clamp (2), for securing the opening for the power cable (1).
3. Hose Clamp (3), for securing the two mated blower housing halves (FIGS. 2 and 3) together, in an air tight seal; or for securing the smaller (or intake) half of the blower housing (FIG. 3) to the mated adaptor collar device (FIG. 4).
4. Hose Clamp (4), for securing output flow piping in place, in an air tight seal.
5. Hose Clamp (5), for securing intake flow piping in place, in an air tight seal.
6. Electric Blower Motor (6), often one horsepower in the standard blower housing (FIG. 1), and often between one and one-half to three horsepower in a blower housing with the adaptor collar device (FIG. 5).
7. Extended Cable Opening (7), for receiving the power cable (1).
8. Extended Output Opening (8), for receiving the output flow piping.
9. Output Restraint Notch (9), for fitting and holding output flow piping in place.
10. Indented Output Fitting Area (10), for securing hose clamp (4) onto exterior part of housing and for holding the output flow piping in place within the fitting area.
11. Indented Housing Fitting (11), for fitting and securing larger half of the two housing pieces under and mated into the smaller half of the two blower housing halves.
12. Male Housing Restraint Notch (12), for fitting and securing larger (or output) half of the two blower housing halves (FIG. 2) into the female housing receptor cite (15) for the protruding notch, on the smaller (or intake) half (FIG. 3) of the two blower housing pieces; or for fitting and securing larger (or output) half of the two housing pieces (FIG. 2) into the female collar receptor cite (17) for the protruding notch (12), on the adaptor collar device (FIG. 4).
13. Intake Restraint Notch (13), for fitting and holding intake flow piping into place.
14. Indented Intake Fitting Area (14), for securing hose clamp (5) onto exterior part of the housing and for holding the intake flow piping in place within the fitting area.
15. Female Housing Receptor Cite (15), for receiving the protruding male housing restraint notch (12) and thereby securing the smaller (or intake) half (FIG. 3) of the two blower housing halves with the second, larger (or output) half (FIG. 2); or for securing smaller (or intake) half of the two blower housing pieces by receiving the protruding male collar restraint notch (19) from the adaptor collar device (FIG. 4).
16. Indented Clamp Fitting Area (16), for securing hose clamp (3) onto part of the blower housing which is fitting and holding the two halves of the blower housing together; or which is fitted to the adaptor collar device (FIG. 4), and is holding the adaptor collar device (FIG.

Figure 5:
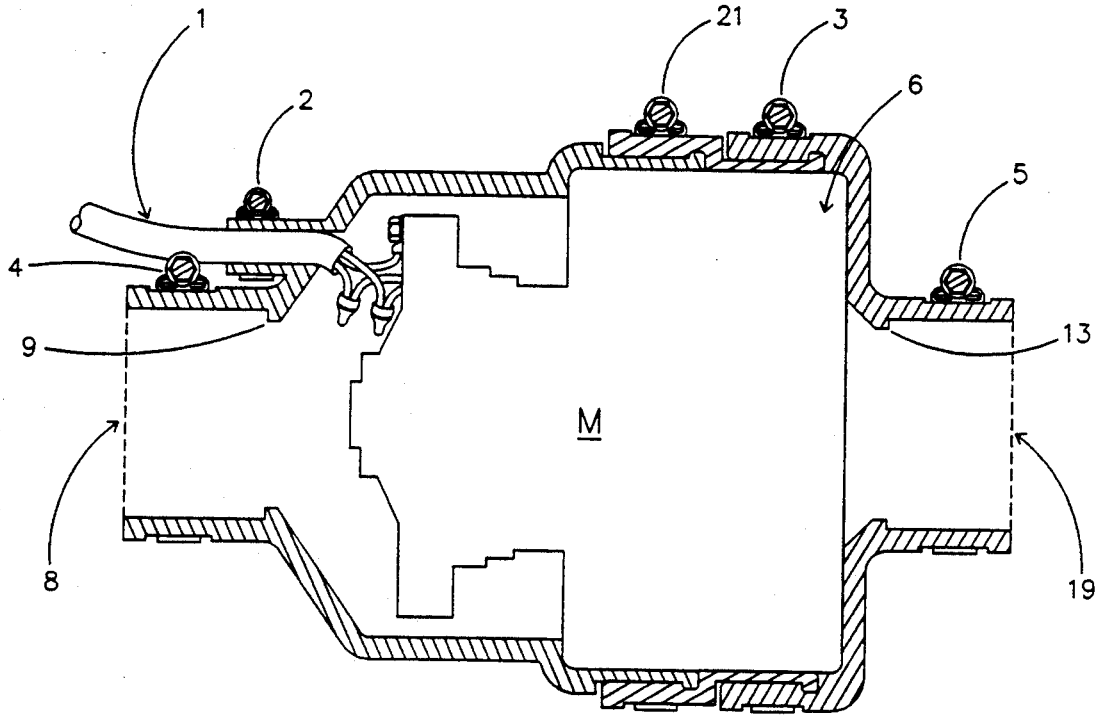
FIG. 5 shows a sectional side view of the blower housing as it would appear when each of the two halves are connected to the adaptor collar device, and these three pieces are held together through the use of two hose clamps.
Figure 6:
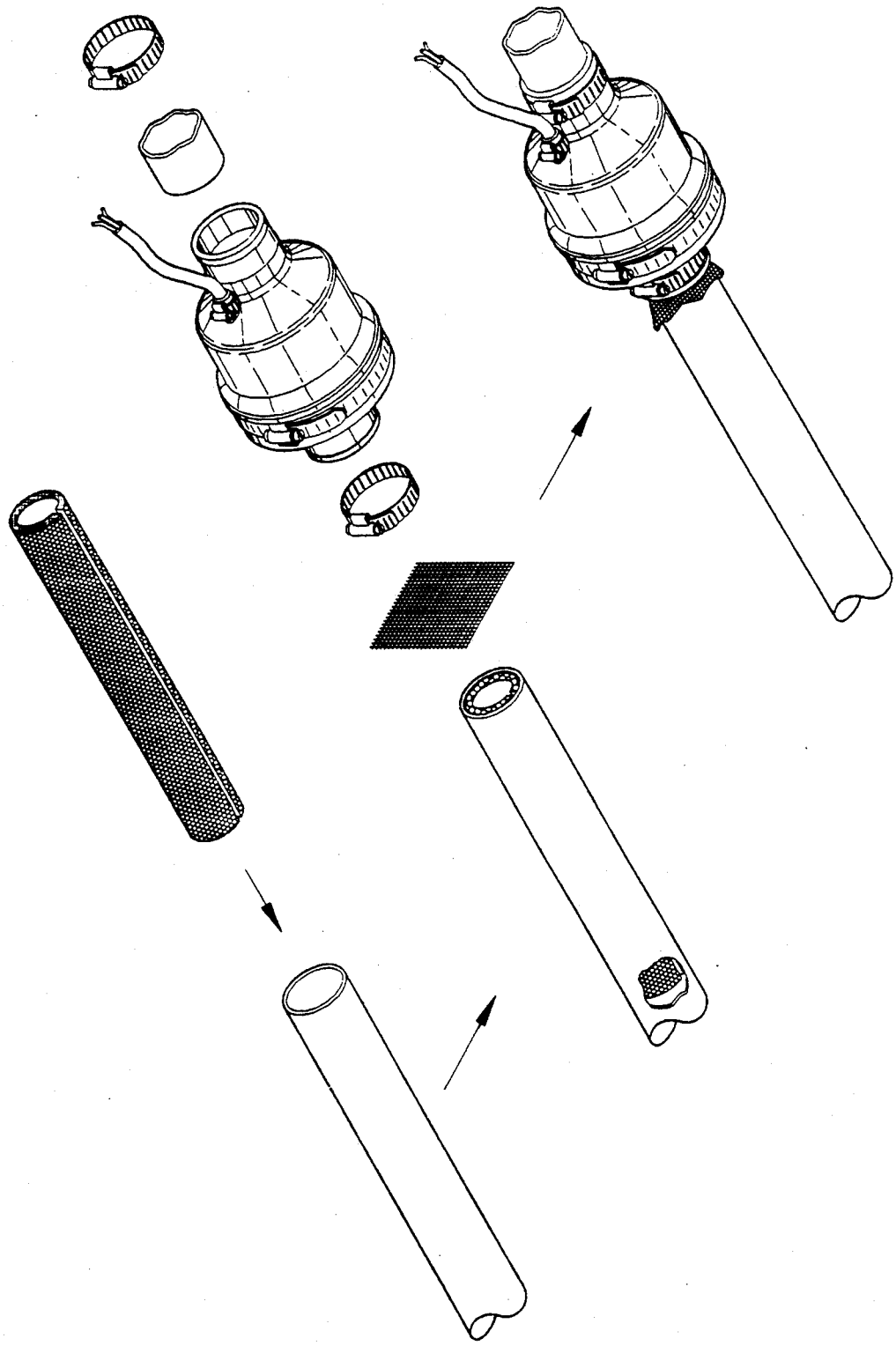
FIG. 6 shows exploded isometric views, illustrating the incorporation of a screen or filter into the extended intake opening and a muffler into a portion of blower housing's intake flow piping.
Figure 7:
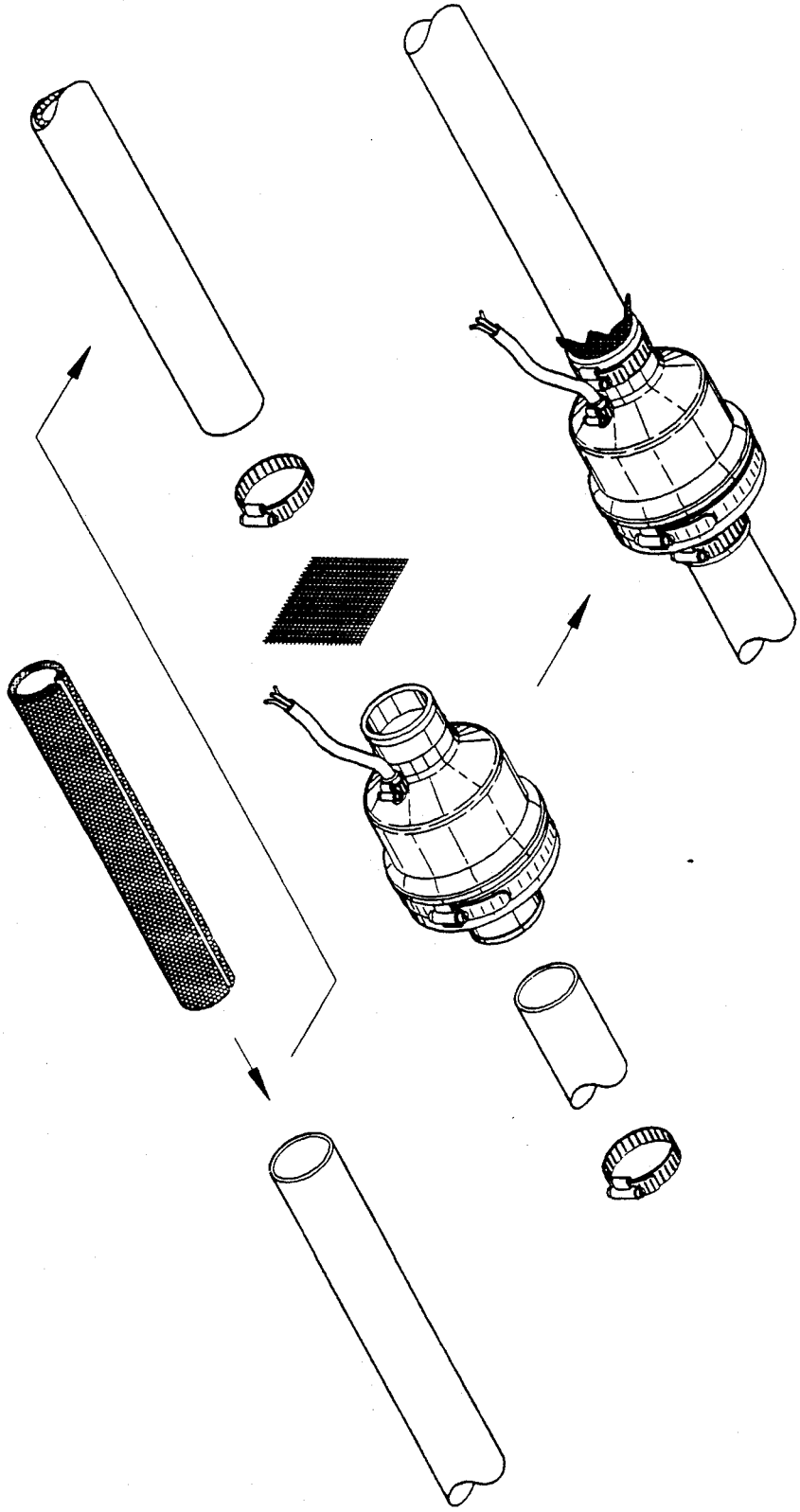
FIG. 7 shows exploded isometric views, illustrating the incorporation of a screen or filter into the extended output opening and a muffler into a portion of the blower housing's output flow piping.
Figure 8:
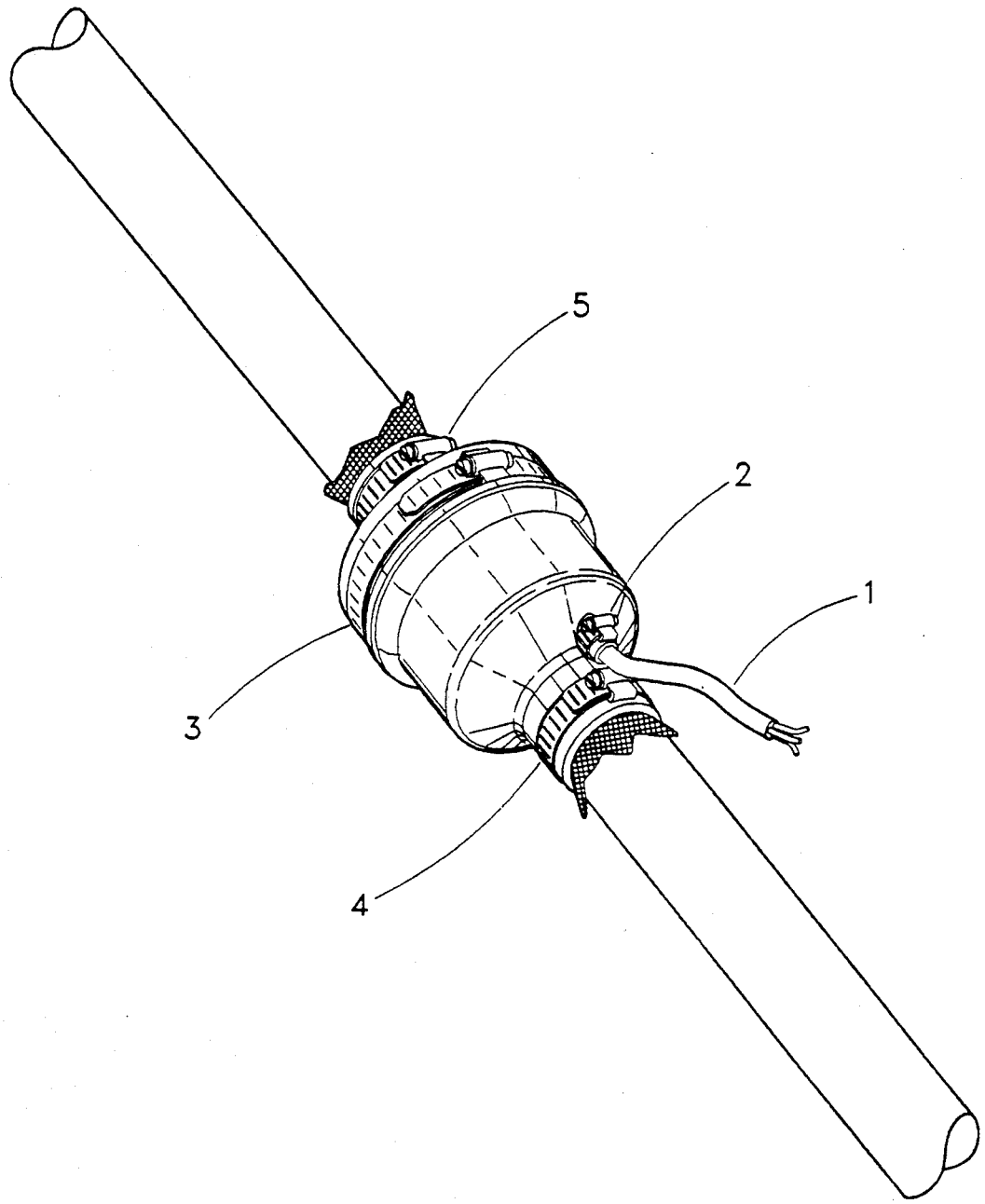
FIG. 8 shows an isometric view, illustrating the incorporation of a screen or filter into the extended intake opening and the extended output opening, and a muffler may be housed within a portion of either the intake flow piping or the output flow piping, as shown in FIGS. 6 and 7, supra.
Figure 9:
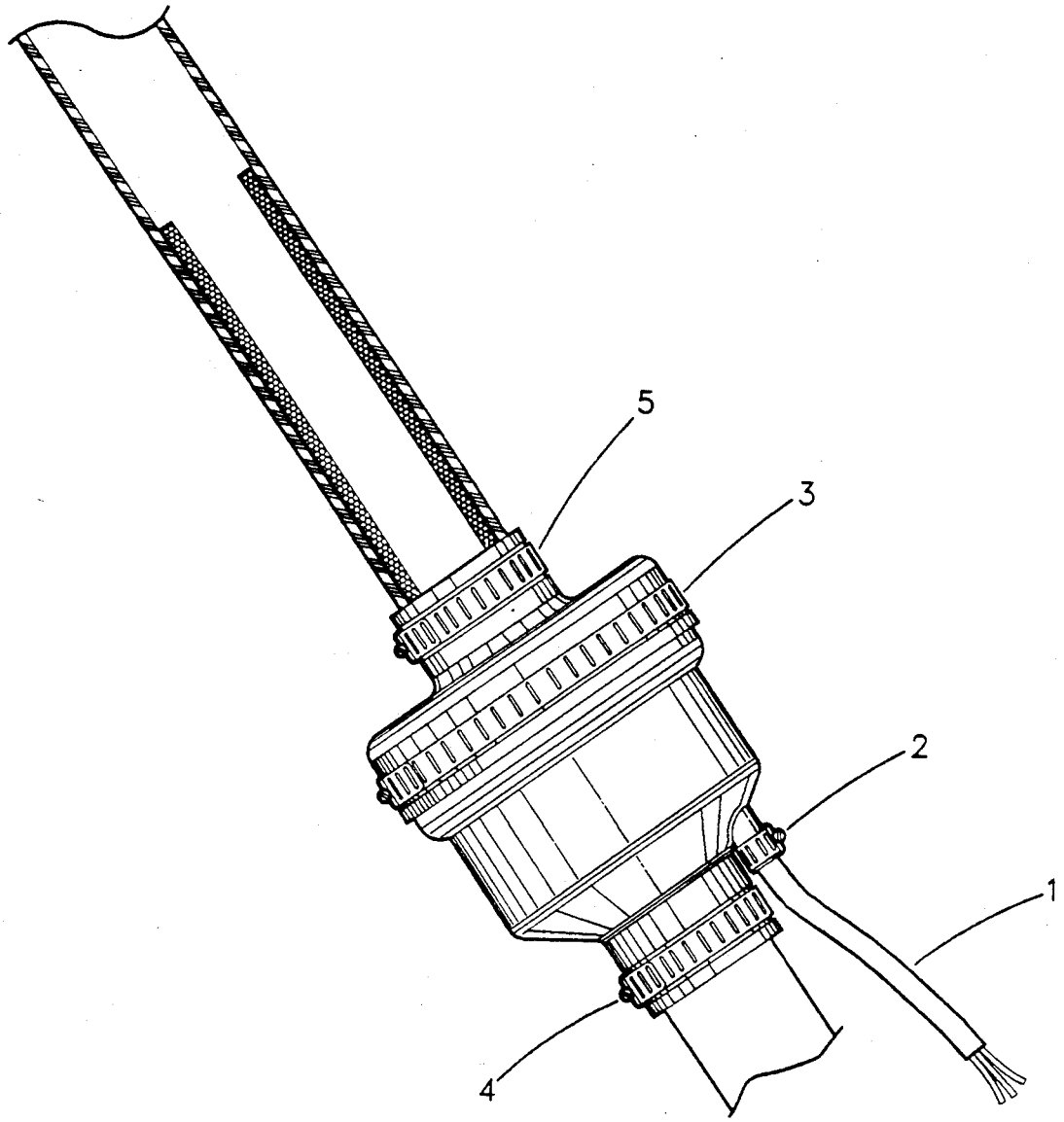
FIG. 9 shows a sectional side view, with the muffler within a portion of the blower housing's intake flow piping.
Figure 10:
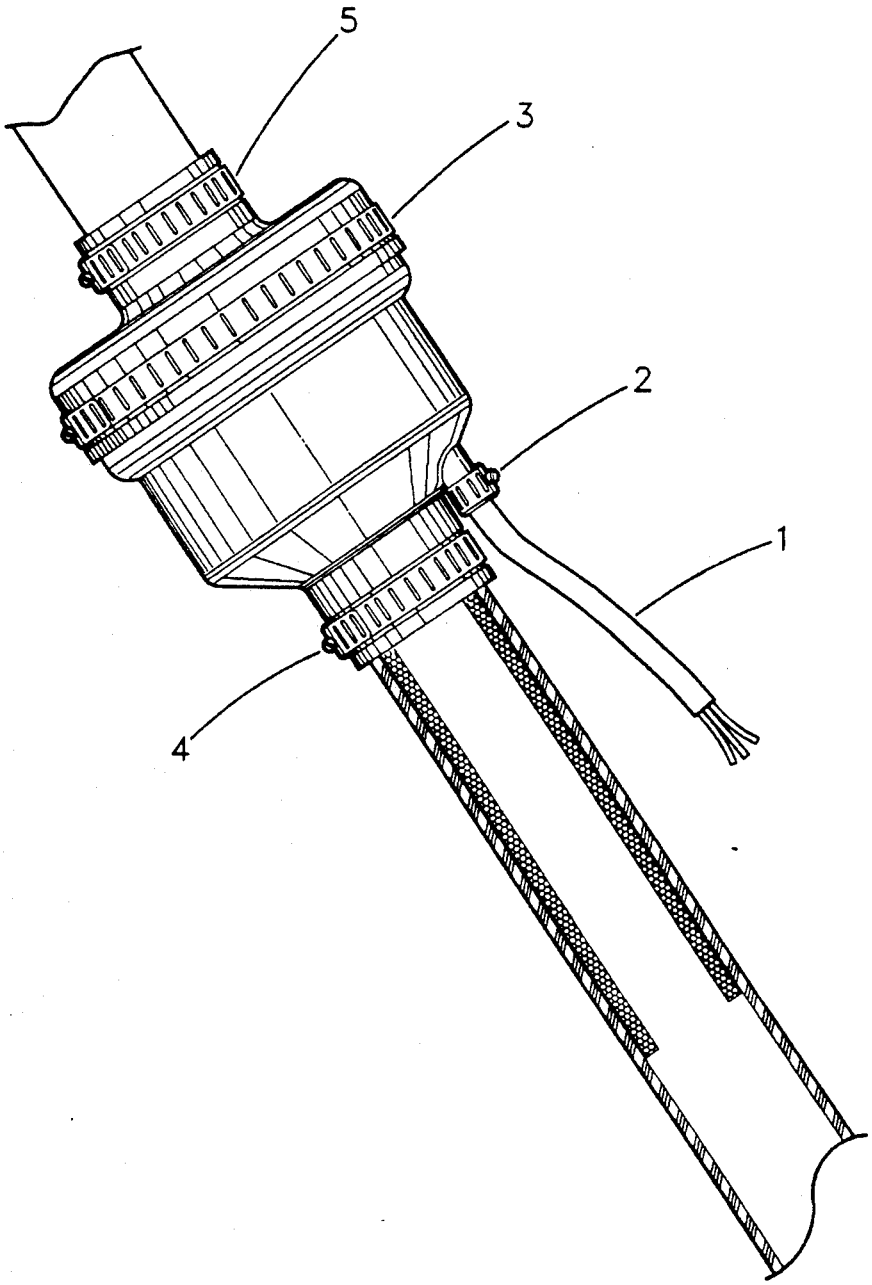
FIG. 10 shows a sectional side view, with the muffler within a portion of the blower housing's output flow piping.
Figure 11:
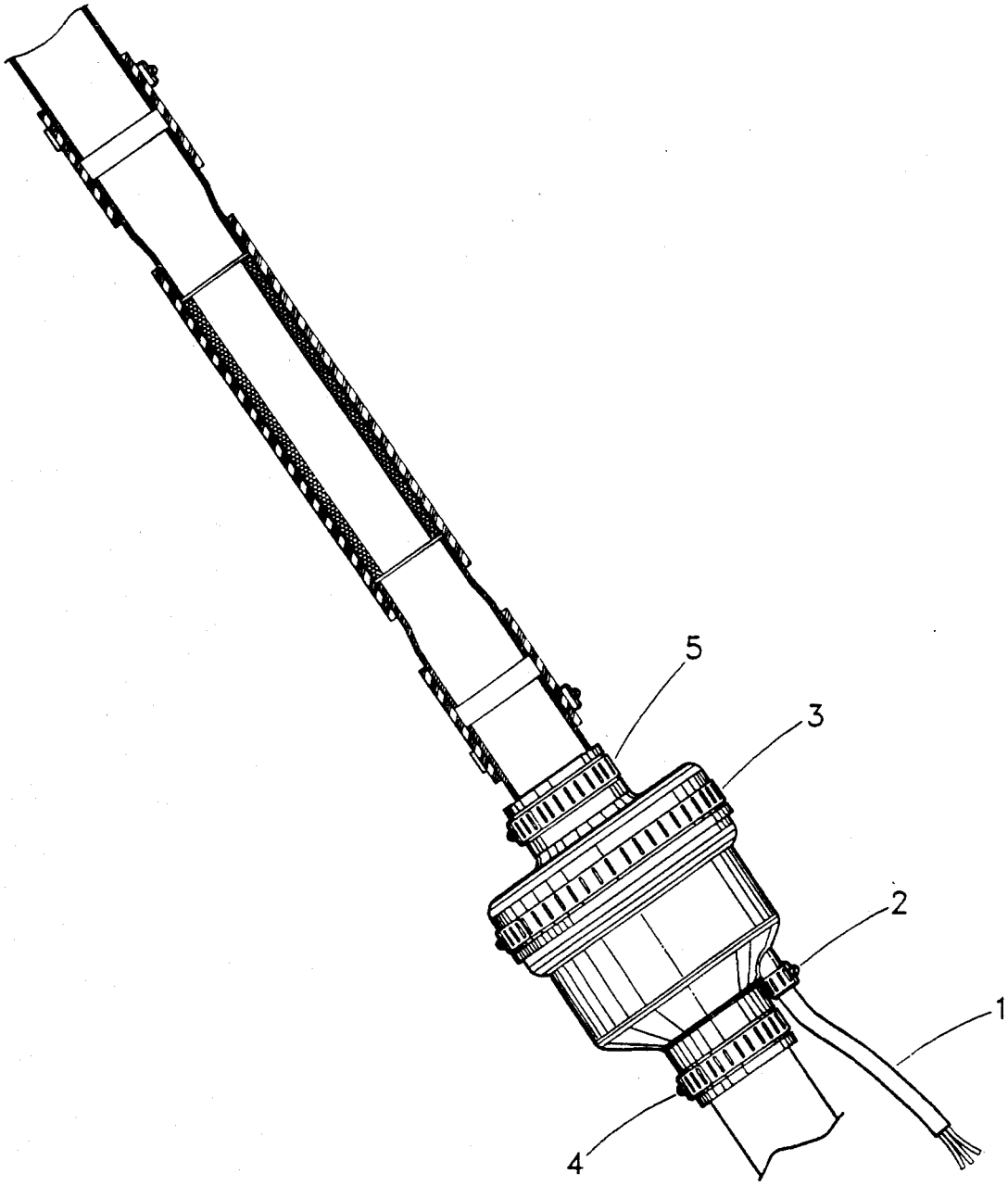
FIG. 11 shows a sectional side view, with the muffler attached with hose clamps to a portion of the blower housing's intake flow piping.
Figure 12:
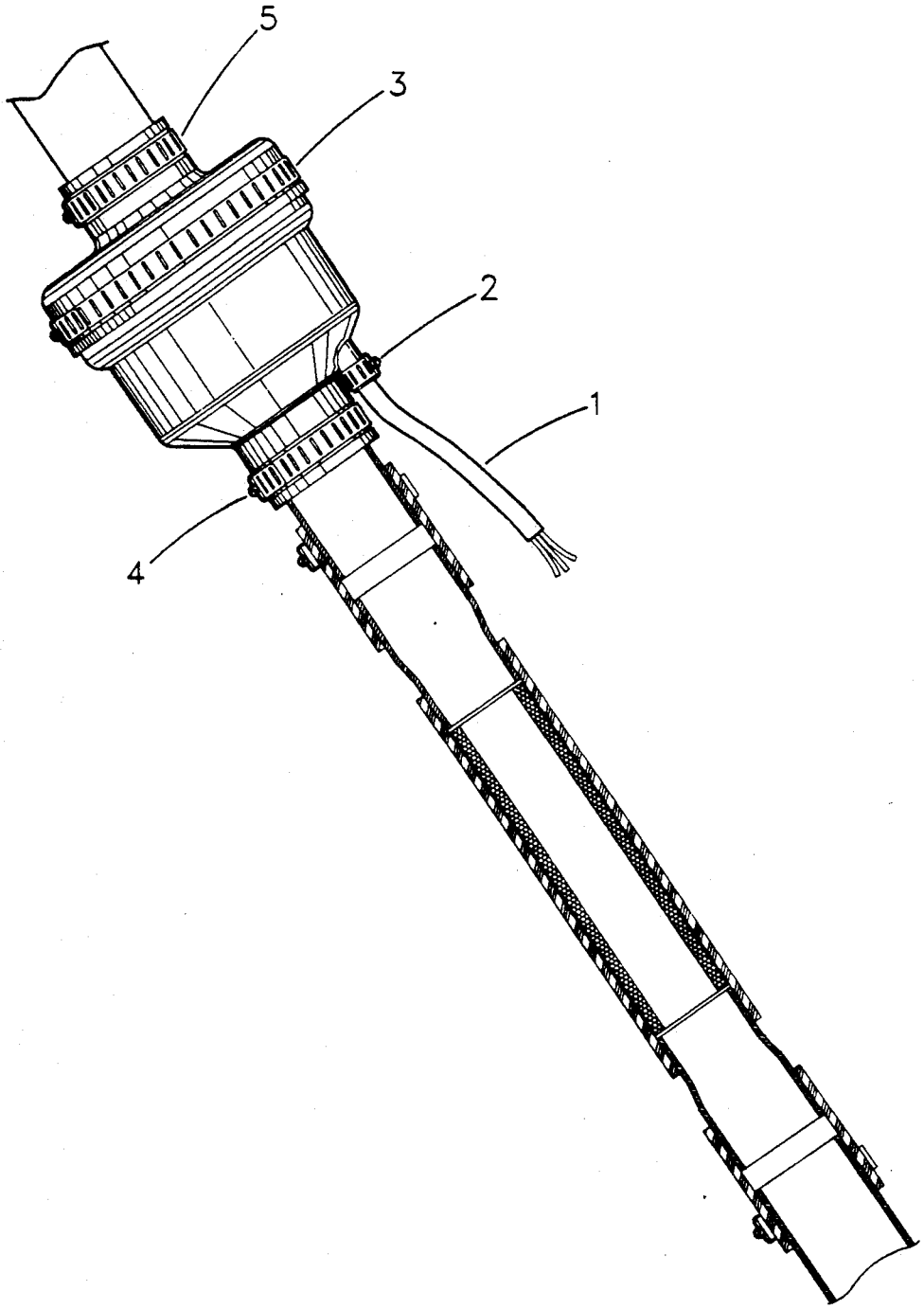
FIG. 12 shows a sectional side view, with the muffler attached with hose clamps to a portion of the blower housing's output flow piping.
Figure 13:
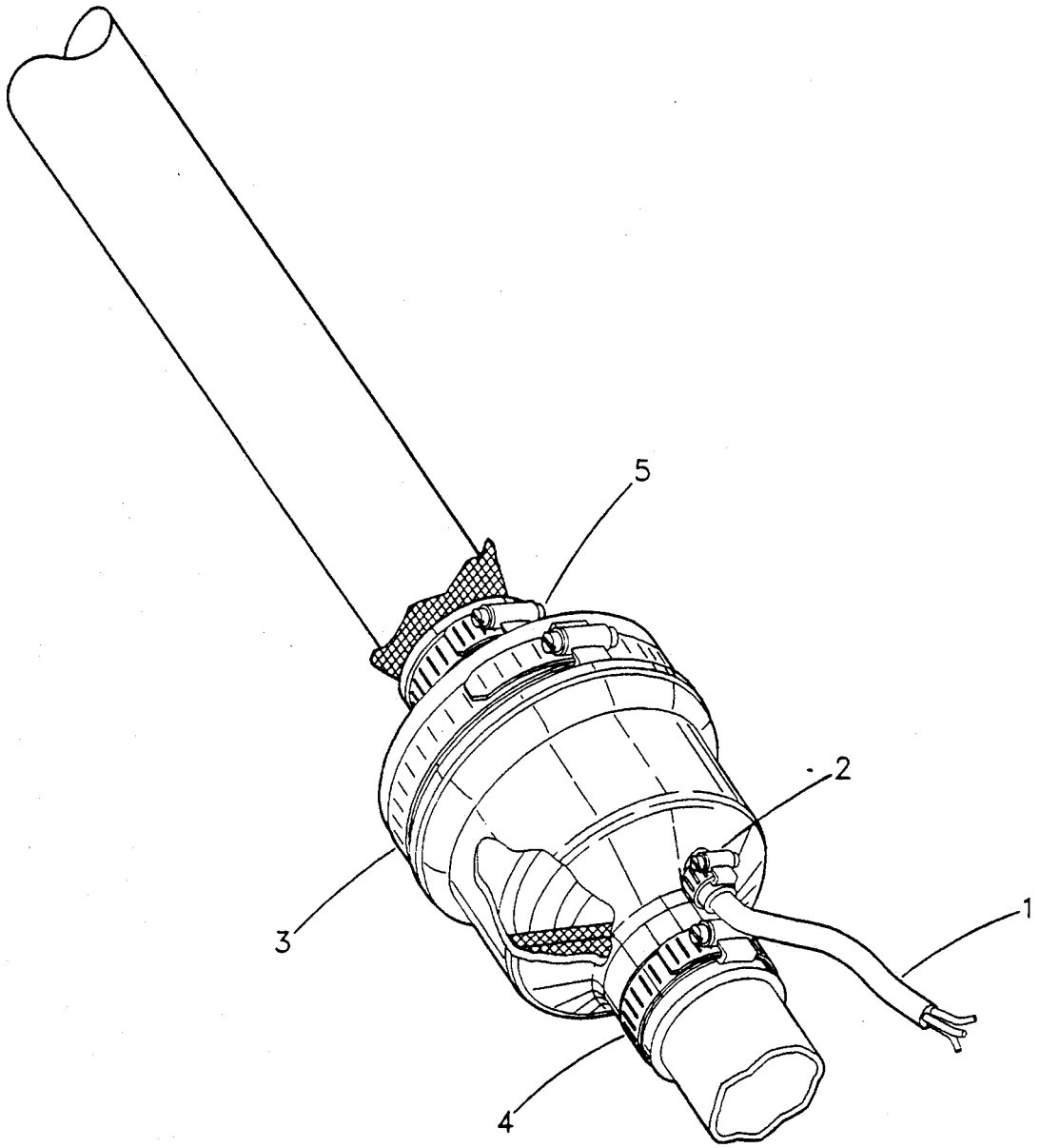
FIG. 13 shows an isometric view of the blower housing with a screen or filter incorporated into the extended intake opening, and showing a cut-away portion of a blower housing, illustrating the optional incorporation of a sound dampening material into the interior housing wall to further silence the blower.
Figure 14:
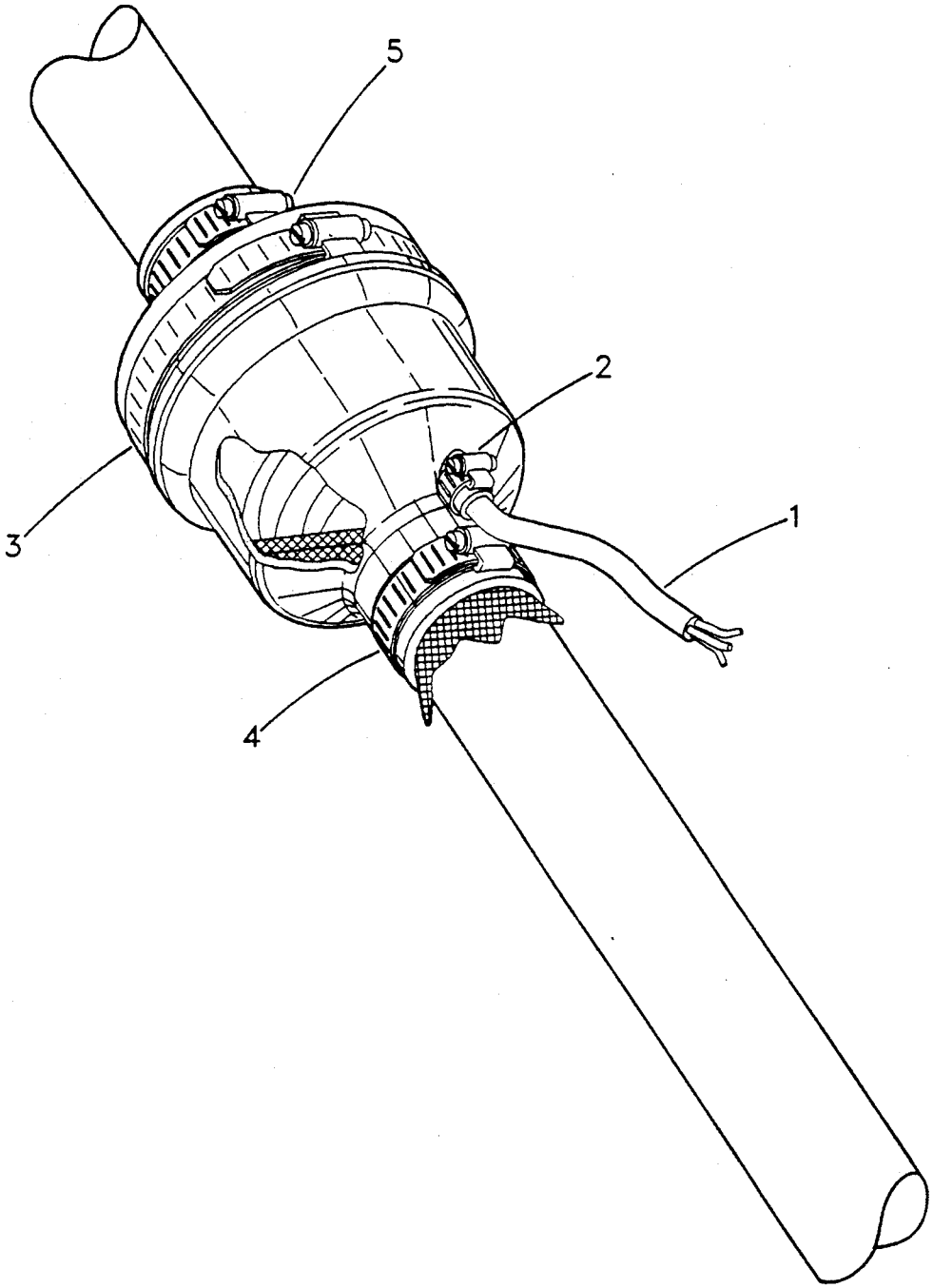
FIG. 14 shows an isometric view of the blower housing with a screen or filter incorporated into the extended output opening, and showing a cut-away portion of a blower housing, illustrating the optional incorporation of a sound dampening material into the interior housing wall to further silence the blower.
Figure 15:
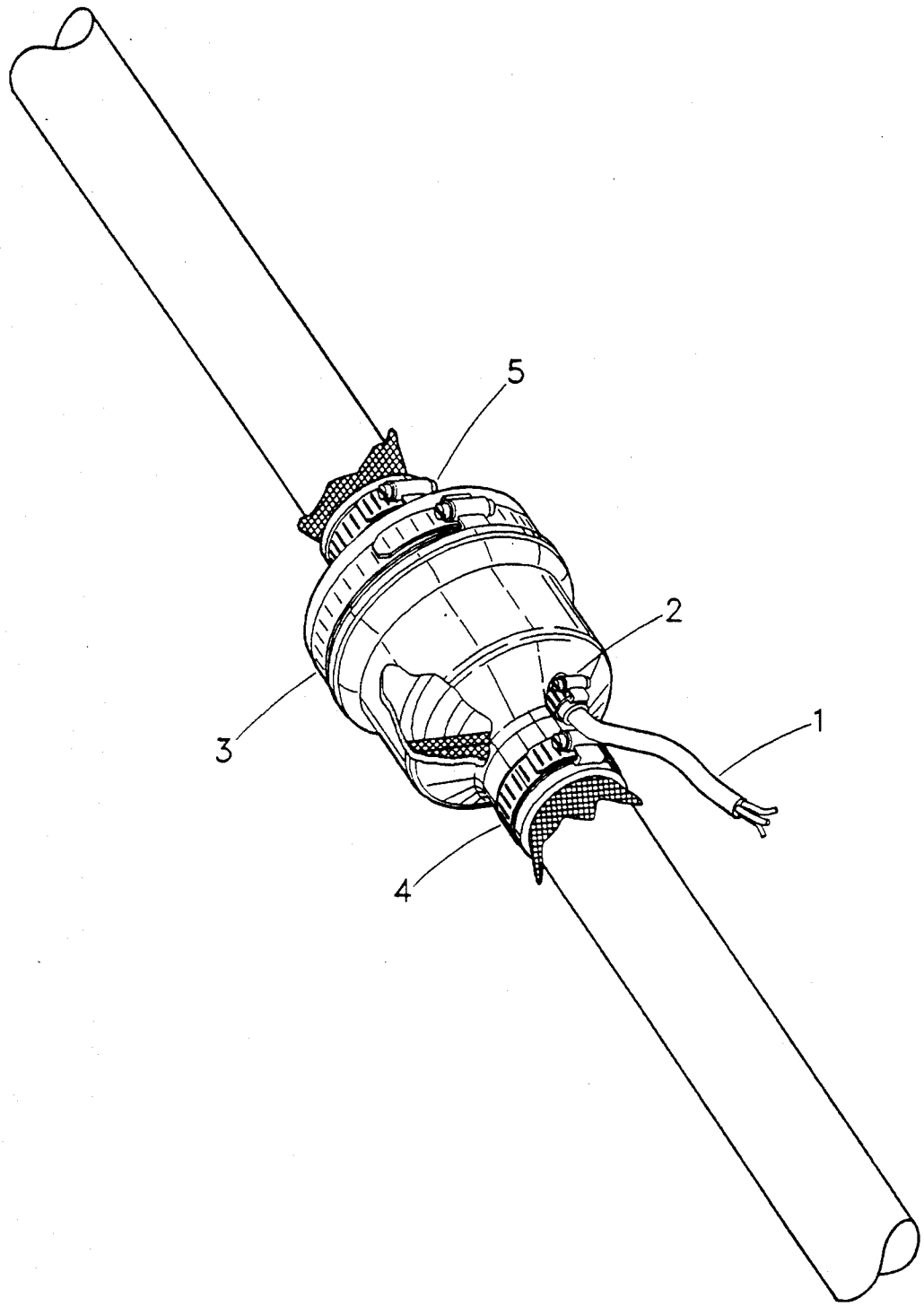
FIG. 15 shows an isometric view of the blower housing with a screen or filter incorporated into both the extended intake opening and the extended output opening, and showing a cut-away portion of the blower housing, illustrating the optional incorporation of a sound dampening material into the interior housing wall to further silence the blower.

4) secure to the two halves of the blower housing (as shown in FIG. 5).

17. Female Collar Receptor Cit (17), for receiving the protruding male housing restraint notch (12).

18. Male Collar Restraint Notch (18), for securing larger (or output) half of the two blower housing halves (FIG. 2) into the female housing receptor cit (15) for the protruding notch, on the smaller (or intake) half of the two blower housing pieces (FIG. 3).

19. Extended Intake Opening (19), for receiving the intake flow piping.

20. Indented Collar Fitting Area (20), for securing a fastening member, such as a hose clamp, onto the adaptor collar device and securing it to the attached half of the blower housing in an air sealed manner.

21. Hose Clamp (21), for securing the adaptor collar device (FIG. 4) to the mated larger (or output) half of the blower housing (FIG. 2), in an air tight seal.

DESCRIPTION OF THE SIMPLE EMBODIMENT

Referring now to the drawing figures, the reference numerals used to describe the various parts of the invention are shown in parenthesis following mention of the part in the text herein. Like reference numerals are used to refer to like specific parts in the various Figures.

Figure 2:
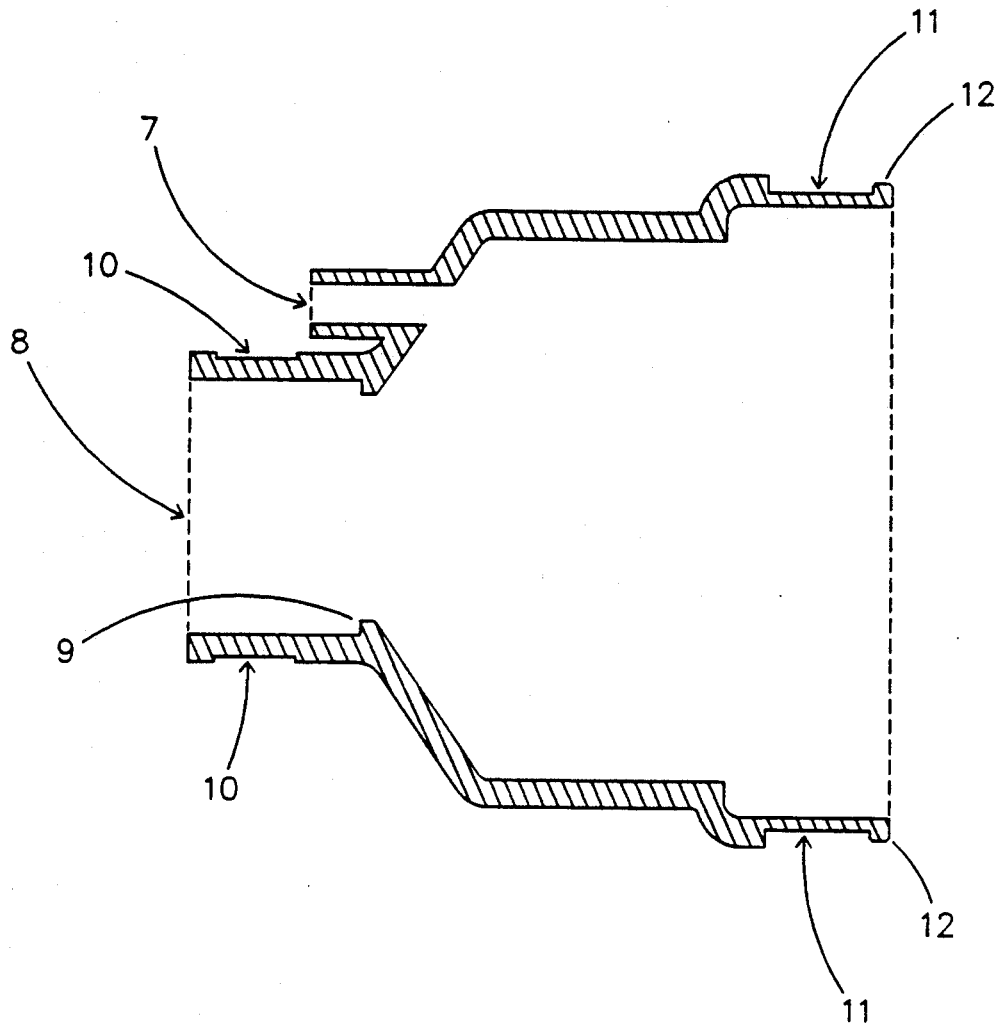
FIG. 2 shows a sectional side view of the larger half (i.e., the output) of the blower housing, as it would appear without the mated second half (i.e., intake) of the housing and their respective hose clamp.
Figure 3:
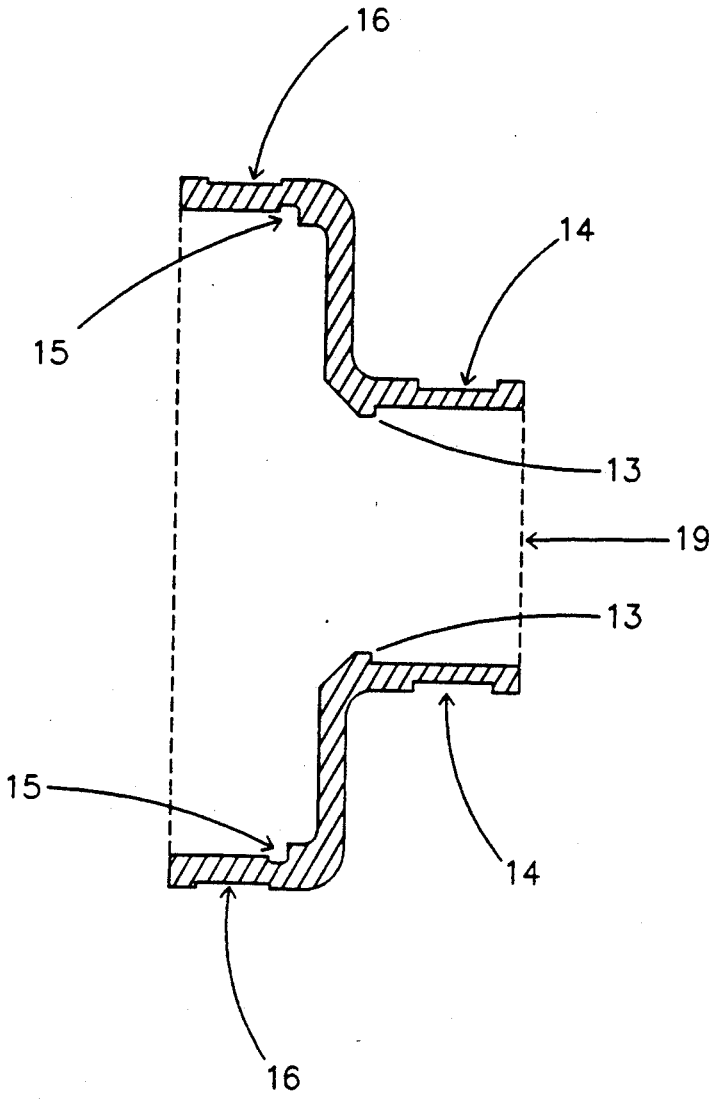
FIG. 3 shows a sectional side view of the half (i.e., the intake) of the blower housing, as it would appear without the mated output half of the housing and their respective hose clamp.
Figure 4:
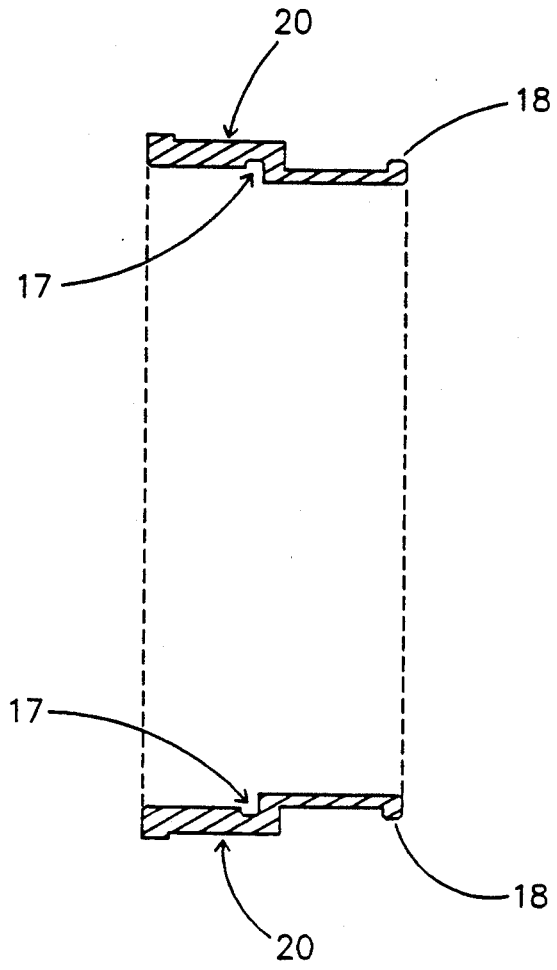
FIG. 4 shows a sectional side view of the adaptor collar device, which may be used to accommodate a larger motor within the blower housing.

In a simple embodiment of the blower housing, as shown in FIGS. 1 through 3, inclusive, a motor (6) is encased in an air-sealed housing, which consists of two housing halves (FIGS. 2 and 3) connectively mated with each other, as shown in FIG. 1. The walls of these two halves (FIGS. 2 and 3) of the blower housing are closed surfaces, except for the above described openings for the electrical power cable (7) , the intake (19) and the output (8). The motor (6) is held or gripped secure in place by the two mated housing halves (FIGS. 2 and 3, and FIG. 1, showing the two blower housing halves connectively mated together), which are fitted and held together in an air tight seal, by a fastening member, such as a hose clamp (3). This hose clamp (3) or other fastening member is secured or bound around the edge or the interface where the two housing halves (FIGS. 2 and 3) connectively fit together. The hose clamp (3) binds, holds and fastens the two blower housing halves (FIGS. 2 and 3) together, thereby holding the motor (6) firmly and securely in place.

The two halves (FIGS. 2 and 3) of the blower housing are also held together by means of a protruding male housing restraint notch (12) on one of the housing halves (FIG. 2) and a mated female housing receptor cite (or notch receptor) (15) in the other housing half (FIG. 3), such that an additional seal is thereby formed, and such seal is fitted in place through the use of the above described mating of the protruding notch (12) and the notch receptor (15). One of the two blower housing halves contains an opening (7) for a power cable (usually electric) to power the motor. This power cable opening (7) is usually circular in shape and the opening and its associated cylindrical path for receiving a portion of the power cable, is usually parallel to the flow piping (i.e., the intake and the output flow piping). The power cable (1) is held in place so as not to have any mechanical strain on the motor/power cable connection, and more importantly, is made air tight, i.e., air sealed by means of a fastening member, such as a hose clamp (2).

When the two blower housing halves (FIGS. 2 and 3) are fitted together with the motor (6) encased within the blower housing, they comprise a unit that may be fitted into the flow piping of e.g., a spa, and used to blow fluids, e.g., air, through the flow piping. The blower housing unit (FIG. 1) is connected to the flow piping at the two openings (8 and 19), on opposite ends of the blower housing unit (FIG. 1). These two openings (8 and 19) are usually circular in shape and are fitted to the flow piping in an air sealed manner by means of a fastening member, such as a hose clamp (4 and 5). When a hose clamp (3) is used to secure the two housing halves (FIGS. 2 and 3) together, the two ends of the blower housing where the flow piping is fitted into the housing (8 and 19) has a band-like groove indented into the exterior of the housing's intake and output openings (10 and 16) to accommodate such hose clamps (4 and 5), and to the largest circumference of the smaller (or intake) housing half (FIG. 3), in order to accommodate such a hose clamp (3) around the mated fitting of the two housing halves (FIGS. 2 and 3).

The two openings of the blower housing unit where the flow piping is fitted into the blower housing unit (8 and 19), include a protruding notch, set of notches, or a band-like notch (9 and 13), hereinafter referred to as the output restraint notch (9) and the intake restraint notch (13), respectively. These restraint notches (9 and 13) protrude from the interior of the intake and the output openings of the blower housing unit (FIG. 1), where the intake and output flow piping (8 and 19) is connectively fitted thereto. These restraint notches (9 and 13) also prevent the flow piping from being set too far or not far enough into the intake and output openings (19 and 8) of the blower housing unit (FIG. 1), and to allow a proper amount of flow piping to be inserted into the housing unit (FIG. 1) to afford the hose clamps (4 and 5) a sufficient amount of flow piping to grip the flow piping and air seal the housing unit (FIG. 1).

This blower housing unit, as shown in FIG. 1, and in FIG. 5 when an adaptor collar is utilized, is in-line and frame independent and may be installed into the flow piping with greater ease than other blower housings that are "available". The vibration and noise from the motor (6) in the present blower housing invention does not resonate through the system as much as with the blower housings that are mounted to the frame of the system or mounted to some other part of the system, where the vibrations may not only resonate, but may amplify the intensity of the vibrations, thereby causing considerable noise and vibration, and even damage to the system. This vibration of the system is likely to cause mechanical breakdown and failure in the system in a shorter period of time than, in systems not experiencing such vibration.

This blower housing unit (FIG. 1) is comprised of an elastomeric material or a polymeric material, e.g., neoprene 60/70 Shore, which has the effect of further dampening the vibration and noise of the blower system, due to its porous and elastomeric material nature and sound absorbing qualities, materials, and which are not used in the materials used heretofore for blower housings in, e.g., the spa industry. Other blower housings are generally constructed of metal or plastic materials, which have a tendency to resonate and sometimes even amplify the vibration and noise of the system. The use a flexible elastomeric material or a polymeric material such as neoprene 60/70 Shore, in the construction of the blower housing (FIG. 1) also make it easier to install and service the blower; e.g., it is easier to fit the motor (6) within the housing (FIG. 1), and to remove the motor 6 for replacement or service.

This blower housing unit (FIG. 1) is generally constructed of cylindrical walls or essentially non-parallel interior walls, as described above, rather than the square or parallel interior walls found in other blower housings. These nonparallel interior walls may be comprised of a plurality of geometries that are spherical or the zone of a sphere, cylindrical, or conical or a frustum of a cone, or a combination of these geometries, in a preferred embodiment. This shape of the interior walls may cause, in some embodiments, the housing itself to have a spherical, cylindrical, or conical shape, or in some other embodiments, a combination of these and other shapes. The effect of these essentially non-parallel interior walls is to further dampen or silence the vibration and noise of the system, particularly the noise emanating from the motor and resonating through the cavities or void spaces of the blower housing and the noise and acoustical waves being scattered about off of these interior walls and within the blower housing. The blower housing (FIG. 1, and FIG. 5, when the adaptor collar device is used) causes a noticeable decibel reduction and a reduction in the unpleasant tones and whistle-like sounds emanating from the blowers typically used in the spa industry.

Essentially nonparallel or cylindrical interior walls are meant to fit around much of the motor (6), and particularly the portions of the motor (6) with the largest circumference, which is often cylindrical or canister in shape, in a snug or tight fit, so as to reduce vibration, flutter, and noise, and to afford an optimal engineering design. In a simple embodiment, the fitting of essentially nonparallel interior walls around this largest circumference of the motor (6), is cylindrical or canister in shape. The snug or tight fit of the housing (FIG. 1) around the motor (6) in a cylindrical or canister fitting, makes the interior wall geometry of the housing (FIG. 1) further acoustically silenced, due to the snug or tight fitting of the elastomeric blower housing (FIG. 1), thereby minimizing further vibration and flutter, and absorbing some of the acoustical noise.

In another simple embodiment, the blower housing (FIG. 5) is used to house a larger motor (6), e.g., a one and one half to a three horsepower motor (6). The blower housing described above (e.g., FIG. 1) may be connectively fitted with an adaptor collar device (FIG. 4), to expand the blower housing size or payload section, thereby affording the housing's interior space to accommodate a larger motor (6), e.g., a one and one half to a three horsepower motor (6), rather than the smaller one horsepower motor (6). This adaptor collar device (FIG. 4) is constructed of an elastomeric material similar to that of the blower housing (FIGS. 1 and 5). This adaptor collar device (FIG. 4) connectively fits securely between the two halves of the blower housing (FIGS. 2 and 3).

A representation of how the adaptor collar device (FIG. 4) connectively fits between these two halves of the blower housing (FIGS. 2 and 3) is shown in FIG. 5. Specifically, the protruding male housing restraint notch (12), which normally mates to the female housing receptor cite (15), is mated to the female collar receptor cite (17); and, the female housing receptor cite (15), which normally houses the protruding male housing restraint notch (12), is mated to the protruding male collar restraint notch (18). This matings of the two halves of the blower housing (FIGS. 2 and 3), with the adaptor collar device (FIG. 4), is shown in FIG. 5. In one embodiment of the adaptor collar device (FIG. 4), there is an indented clamp fitting area (20), for securing a fastening member, such as a hose clamp (21) onto and around the adaptor collar device (FIG. 4) and securing it in an air sealed manner to the mated larger (or output) half of the blower housing (FIG. 2).

Another simple embodiment of the present invention has the intake opening (19) significantly larger than the output opening (8), in order to create a more highly pressured output flow for use, e.g., in specialized air jets in: 1) spas and 2) various shapes of massage seats and lounges in spas; and, for use in various spa attachments and accessories. An Adaptor insert may also be placed in the intake opening (19) and the output opening (8), to modify the effective size of the openings (19 and 8) in order to, e.g., accommodate varying sizes of flow piping.

Another embodiment of the present invention utilizes a screen, prefilter, filter, or filter assemblies in the proximity of the extended intake opening (19), or in the proximity of the extended output opening (8), in order to filter out dirt, dust, carbon particles from the blower motor, and other undesired fluid or air impurities. The screen, prefilter or filter may be inserted, e.g., within the extended output opening (8) or may be fitted to the output flow piping. When inserted into, e.g., the extended output opening (8), the screen, prefilter or filter may be easily replaced through the unfastening of the fastening member (4), and when the fastening member is a hose clamp (4), the loosening of one screw may take the removal or service of the screen, prefilter or filter quick and easy.

Another embodiment of the present invention utilizes additional sound dampening material or materials on a part of or on the entire surface of the nonparallel interior walls, of the blower housing (FIG. 1), in order to further silence the noise and vibration emanating from the blower motor (6) and the fluid flow through the blower housing (FIG. 1). This additional sound dampening material may have the further benefit of filling or partially filling the cavity or void space within the blower housing (FIG. 1). This embodiment may be particularly useful in, e.g., special acoustically silenced aeration and filtration devices and systems used, e.g., in homes and industry, where such silencing of acoustical noise may be critical.

Another embodiment of the present invention utilizes a muffler attached to the flow piping at the extended output opening (8) or the extended intake opening (19), for additionally silencing the blower (FIG. 1). The muffler may be attached or removed for service or replacement through the unfastening of the fastening member (4), and when the fastening member is a hose clamp (4), the loosing of one screw may make the removal or service of the muffler quick and easy.

DESCRIPTION OF A PREFERRED EMBODIMENT

A preferred embodiment, which may be used in the spa industry, has the following approximate dimensions:

1) Electric Power Cable: sufficient length to the power source and to have enough slack to provide for vibration and movement of the flow piping, as well as for safe and easy disassembly of the housing for service.

2) Hose Clamp (2), for securing the power cable (1): approximately $\frac{5}{8}$ inch nominal.

3. Hose Clamp (3), for securing the two mated blower housing halves (FIGS. 2 and 3) together: approximately 6 and $\frac{3}{8}$ inches nominal.

4) Hose Clamp (4), for securing output flow piping: approximately 2 and ¾ inches nominal.

5) Hose Clamp (5), for securing intake flow piping: approximately 2 and ¾ inches nominal.

6) Electric Blower Motor (6): often between one and two horsepower, in this embodiment as used in the spa industry.

7) Extended Cable Opening (7): outside diameter is approximately 0.625 inch.

8) Extended Output Opening, for output piping (8): inside diameter is approximately 2.355 inches in diameter.

9) Output Restraint Notch (9), for fitting and holding output flow piping into place: protruding approximately 0.15 inch.

10) Indented Output Fitting Area (10), for securing hose clamp onto part of housing holding the output flow piping: strip or band is approximately 0.062 inch deep.

11) Indented Housing Fitting (11), for securing larger half of the two housing pieces under and into the smaller half of the two housing pieces: approximately 0.25 inch deep.

12) Male Housing Restraint Notch (12), for securing larger half of the two housing halves into the female housing receptor cite (15) for the protruding notch (12), on the smaller half of the two housing pieces (FIG. 3); or for securing larger half of the two housing pieces (FIG. 2) into the female collar receptor cite (17) for the protruding notch (12), on the adaptor collar device (FIG. 4): protruding approximately 0.2 inch.

13) Intake Restraint Notch (13), for fitting intake flow piping into place: protruding approximately 0.15 inch.

14) Indented Intake Fitting (14), for securing hose clamp (5) onto part of the housing holding the intake flow piping: strip or band is approximately 0.062 inch deep.

15) Female Housing Receptor Cite (15), for receiving male housing restraint notch (12) and thereby securing the smaller half of the two housing halves with the second, larger half; or for securing smaller half of the two housing pieces (FIG. 3) by receiving the male collar restraint notch (18) from the adaptor collar device (FIG. 4): approximately 0.2 inch deep.

16) Indented Clamp Fitting (16), for securing hose clamp onto part of the housing which is fitting or holding the two halves of the housing (FIGS. 2 and 3) together; or which is fitted to the adaptor collar device (FIG. 4), and is holding the adaptor collar device secure (FIG. 4) to the two mated halves of the housing: strip or band is approximately 0.062 inch deep.

DESCRIPTION OF A PRESSURIZED HALF-HOUSING EMBODIMENT

Another embodiment, which may be used in the spa industry or in the air purification industry, was discovered during experimentation and testing of the blower housing (FIG. 1). It was found that the output (or larger) half of the blower housing (FIG. 2) could house most of the blower motor (6). It was also found that the blower motor and the half-housing could be pressure sealed through the use of: 1) the hose clamp (2) for securing and air-sealing the opening for the electric power cable (1), 2) the hose clamp (4) for securing and air-sealing the output flow piping in place, and 3) the hose clamp (3 for securing and air-sealing the output (or larger) half of the blower housing (FIG. 2) around most of the largest cylindrical or canister section of the blower motor (6). It was found that the suction of the forced air through the blower created a positive seal, which further sealed the motor (6) within the blower half-housing (FIG. 2).

The use of only the output (or larger) half of the blower housing (FIG. 2) for housing and sealing the output end of the blower motor (6) with the hose clamp (3), was found to provide the blower motor (6) with adequate acoustical silencing to make the use of this half-housing (FIG. 2) a cost efficient method of housing, silencing, and air-sealing the blower motor (6). This half-housing embodiment also has the advantage of not having any O-ring or glue-joint seals. The air output piping is fastened, secured and air-sealed to the extended output opening (8) of the half-housing (FIG. 2) with a hose clamp (4), and there is no input piping to fasten or secure to the blower motor (6) or blower half-housing (FIG. 2). The power cable (1) is fastened, secured and air-sealed using a hose clamp (2) and the blower half-housing (FIG. 2) is fastened, secured and air-sealed around most of the largest cylindrical or canister section of the blower motor (6) with a hose clamp (3). The hose clamp (3) is fit into and around the band-shaped indented housing fitting (11), and the hose clamp (3) is further secured into this fitting position by the male housing restraint notch (12), which may be a protruding band or notch around the outer perimeter of the indented housing fitting (11).

This half-housing embodiment may be more easily disassembled for service or replacement of the blower motor (6), because there are no glue-joints, and because the one screw on the hose clamp (3) for securing, fastening and air-sealing the blower half-housing (FIG. 2) around the largest cylindrical or canister section of the blower motor (6), loosens the band of the hose clamp (3), and allows the hose clamp (3) to be removed from the half housing (FIG. 2), thereby allowing for a quicker removal of the blower motor (6). This half-housing embodiment also allows for a quicker assembly of the blower motor (6) into the half-housing (FIG. 2) because there are no glue-joints, and there are only the three hose clamp fitting to be fastened and air-sealed: 1) the hose clamp for the electric power cable (2), 3) the hose clamp for the output flow piping (4), and the hose clamp for tightly gripping and air-sealing the output end and most of the cylindrical or canister section of the blower motor (6) within the half-housing (FIG. 2). The use of this half-housing embodiment by a manufacturer provides a cost savings in labor time, a stream-lining of the assembly process, a more efficient time-motion process in blower assembly, and a cost savings in materials by requiring only the output half of the blower housing (FIG. 2), thereby making the half-housing (FIG. 2) itself less expensive to manufacture. Blower motors have heretofore required a complete housing of the blower motor in order to avoid pressure leaks, which: 1) reduce the blower's efficiency and 2) increase its noise output.

This half-housing embodiment may be attached and air-sealed to the output flow piping in a number of positions, thereby facing the intake to the blower motor in a number of positions opposite that of the blower output. This half-housing embodiment may be positioned to receive air into its intake from positions where the intake is facing upward, downward, or in a number of sideways or horizontal positions.

When the motor intake of this half-housing embodiment is desired in the upward position for pumping air to the various air injectors or air jets in a spa, the half-housing (FIG. 2) is attached with a hose clamp (4) to the air output flow piping, and such air output flow piping should be rigid enough to support the half-housing (FIG. 2) with the intake end of the blower motor (6) in an upward position, i.e., with the blower motor intake at the top, drawing-in air. The output flow piping travels downward initially and then travels in a circuit around the outside of the spa wall, where various T-joints on the circuit feed forced air through the various air injectors or air jets in the spa wall, and into the water-filled spa.

When the motor intake of this half-housing embodiment is desired in the downward position for pumping air to the various air injectors or air jets in a spa, the half-housing (FIG. 2) is attached with a hose clamp (4) to the air output flow piping and such air output flow piping should be rigid enough to hold the half-housing (FIG. 2) with the intake end of the blower motor (6) in a downward position, with the blower motor (6) intake on the bottom, drawing-in air. The intake end of the blower motor (6) preferably would fit into a separate perforated receptical, through which the intake air would be forced by the blower motor (6), and which would preferably possess a screen or filter over the outside perforations of the receptical or within the receptical and over the perforations, for filtering the intake air and preventing undesired materials from entering the blower motor's impeller or the air distribution system. The output flow piping travels upward initially and then travels in a circuit around the outside of the spa wall, where various T-joints on the circuit feed forced air through the various air injectors or air jets in the spa wall, and into the water-filled spa. The receptical which is holding the intake end of the blower motor (6) may be constructed of a flexible elastomeric or polymeric material such as, e.g., neoprene 60/70 Shore, and such an embodiment would have a hose clamp fitting area and a hose clamp to further fasten and secure the blower's intake end to the receptical.

When the motor intake of this half-housing embodiment is desired in a sideways or horizontal position for pumping air to the various air-injectors or air jets in a spa, the half-housing (FIG. 2) is attached with a hose clamp (4) to the air output flow piping and such air output flow piping should be rigid enough to hold the half-housing (FIG. 2) with the intake end of the blower motor (6) in a sideways or horizontal position. The intake end of the blower motor (6) may preferably fit into a separate receptical with perforations on its side, through which the intake air would be forced by the blower motor (6), and which would preferably possess a screen or filter over the outside perforations of the receptical or within the receptical and over the perforations, for filtering the intake air and preventing undesired materials from entering the blower motor's impeller or air distribution system. The output flow piping then travels in a circuit around the outside of the spa wall, where various T-joints on the circuit feed forced air through the various air injectors or air jets in the spa wall, and into the water-filled spa. The receptical which is holding the intake end of the blower motor (6) may be constructed of a flexible elastomeric or polymeric material such as, e.g., neoprene 60/70 Shore, and such an embodiment would have a hose clamp fitting area and a hose clamp to further fasten and secure the blower's intake end to the receptical.

This half-housing embodiment is also well suited for lower cost portable spas and spas which use skid packs, because of the utility and low cost of the half-housing.

While I have shown and described in this disclosure only selected embodiments in accordance with the present invention, it is understood that the same is not limited thereto, but is susceptible to numerous changes and modifications as known to one having ordinary skill in the art, and I therefore do not wish to be limited to the details shown and described herein, but intend to cover all such modifications, changes, additions, and eliminations, as are encompassed by the scope of the appended claims.

I claim:

1. A blower housing, suitable for housing a blower motor which blows fluids, including air, comprised of:

a. a material selected from the groups of materials known as polymeric and elastomeric materials, b. two blower housing halves, such that the first half contains the intake opening, and the second half contains the output opening, c. said intake opening is on the opposite end of the blower housing in relation to said output opening, so that the fluid will flow in-line through said housing, and said intake opening and said output opening each are extended in order to accommodate one end of the blower system's intake flow piping into the extended intake opening and one end of said blower system's output piping into the extended output flow opening, d. said two blower housing halves are matedly connected together by the mating of the male housing restraint notch, located on the end of the indented housing fitting on the output half of the blower housing, to the mated female housing receptor cite located on the intake half of the blower housing, e. said two blower housing halves which are matedly connected together, are further held together through the use of a fastening means around the mated connection of the two blower housing halves, f. an interior geometry which consists essentially of nonparallel interior walls, and said walls may have a geometry which is spherical, the zone of a sphere, cylindrical, conical, the frustrum of a cone, or a combination of these geometries, g. said extended intake opening has an intake restraint notch on the interior of said extended intake opening, for fitting and positioning the end of the intake flow piping into place, and said extended output opening has an output restraint notch on the interior of said extended output opening, for fitting and positioning the end of the output flow piping into place, h. an extended cable opening for an electric power cable to be connected to the blower motor, and said motor is housed within said housing, i.e., the two matedly connected housing halves, i. a fastening means for securing needed portion of said electric power cable within said extended cable opening, and j. a fastening means for securing said intake flow piping in said extended intake opening, and a fastening means for securing said output flow piping in said extended output opening.

2. A blower housing, as recited in claim 1, wherein said housing is comprised of the material known as neoprene, and which is between 60 and 70 Shore in hardness.

3. A blower housing, as recited in claim 1, wherein said fastening means are suitable fitted hose clamps, for sealing and securing:

a. needed portion of said electric power cable within said extended cable opening, b. said flow piping to their respective extended intake or output openings on said housing, and c. said two halves of said blower housing matedly and connectively together.

4. A blower housing, as recited in claim 3, wherein said hose clamps are set or secured in place with:

a. an indented intake fitting area on the exterior of said extended intake opening, for setting and securing said hose clamp onto exterior part of intake end of said housing, b. an indented output fitting area on the exterior of said extended output opening, for setting and securing said hose clamp onto exterior part of output end of said housing, and c. an indented clamp fitting area on the exterior of portion of said intake half of said housing, in such a manner as to secure said mated connection between said intake half of said housing with said output half of said housing.

5. A blower housing, as recited in claim 1, wherein a screen, prefilter, or filter is inserted within said extended intake opening, between said intake restraint notch and said intake flow piping.

6. A blower housing, as recited in claim 1, wherein a screen, prefilter, or filter is inserted within said extended output opening, between said output restraint notch and said output flow piping.

7. A blower housing, as recited in claim 1, wherein a screen, prefilter, or filter is inserted within said extended intake opening, between said intake restraint notch and said intake flow piping, and a screen, prefilter, or filter is also inserted within said extended output opening, between said output restraint notch and said output flow piping.

8. A blower housing, as recited in claim 1, wherein a muffler is connected between said extended intake opening and said intake flow piping.

9. A blower housing, as recited in claim 1, wherein a muffler is connected between said extended output opening and said output flow piping.

10. A blower housing, as recited in claim 1, wherein additional sound dampening material is on a portion of the surface of the nonparallel interior walls of said housing.

11. A blower housing, as recited in claim 1, wherein additional sound dampening material is on the entire surface of the nonparallel interior walls of said housing.

12. A blower housing, as recited in claim 1, wherein additional sound dampening material is inserted within said housing.

13. A blower housing, suitable for housing a blower motor which blows fluids, including air, comprised of:

a. a material selected from the groups of materials known as polymeric and elastomeric materials, b. two blower housing halves, such that the first half contains the intake opening, and the second half contains the output opening, c. said intake opening is on the opposite end of the blower housing in relation to said output opening, so that the fluid will flow in-line through said housing, and said intake opening and said output opening each are extended in order to accommodate one end of the blower system's intake flow piping into the extended intake opening and one end of said blower system's output piping into the extended output flow opening, d. said intake half of said blower housing is matedly fitted and connected to an adaptor collar device, such that the female housing receptor cite on the intake half of said housing is matedly fitted and connected to the male collar restraint notch on said adaptor collar device, and the male housing restraint notch on the output half of said housing is matedly fitted and connected to the female collar receptor cite on said adaptor collar device, e. said two blower housing halves, which are matedly fitted and connected to said adaptor collar device, to form an elongated blower housing for housing larger blower motors, are further held together through the use of a fastening means, f. an interior geometry of the adaptor collar device which is essentially cylindrical, g. an interior geometry of said blower housing with said adaptor collar device matedly fitted thereon, which consists essentially of nonparallel interior walls, and said walls have a geometry which is essentially cylindrical, and may additionally be spherical, the zone of a sphere, cylindrical, conical, the frustrum of a cone, or a combination of these geometries, h. said extended intake opening has an intake restraint notch on the interior of said extended intake opening, for fitting and positioning the intake flow piping into place, and said extended output opening has an output restraint notch on the interior of said extended output opening, for fitting and positioning the output flow piping into place, i. an extended cable opening for an electric power cable to be connected to the blower motor, and said motor is housed within said housing and its matedly fitted adaptor collar device, j. a fastening means for securing needed portion of said electric power cable within said extended cable opening, and k. a fastening means for securing said intake flow piping in said extended intake opening, and a fastening means for securing said output flow piping in said extended output opening.

14. A blower housing as recited in claim 13, wherein said housing and said adaptor collar device are comprised of the material known as neoprene, and which is between 60 and 70 Shore in hardness.

15. A blower housing as recited in claim 13, wherein said fastening means are suitably fitted hose clamps, for sealing and securing:

a. needed portion of said electric power cable within said extended cable opening.

b. said intake flow piping and said output flow piping to their respective extended openings on said housing, c. said intake half of said housing to said adaptor collar device, and said output half of said housing to said adaptor collar device, thereby creating an elongated blower housing.

16. A blower housing as recited in claim 15, wherein said hose clamps are set or secured in place with:

a. an indented intake fitting area on the exterior of said extended intake opening, for setting and securing said hose clamp onto exterior part of the intake end of said housing, b. an indented output fitting area on the exterior of said extended output opening, for setting and securing said hose clamp onto exterior part of output end of said housing, and c. an indented clamp fitting area on the exterior of portion of said intake half of said housing, in such a manner as to secure said mated connection between said intake half of said housing with mated portion of adaptor collar device, and an indented collar fitting area on the exterior portion of said adaptor collar device, in such a manner as to secure said mated connection between said output half of said housing with the mated portion of said adaptor collar device.

* * * * *